United States Patent [19]

Kuboi et al.

[11] Patent Number: 4,797,122

[45] Date of Patent: Jan. 10, 1989

[54] DRIP-PROOF CONNECTOR

[75] Inventors: Sadao Kuboi; Tomonari Ohtsuki, both of Mooka, Japan

[73] Assignee: Daiichi Denshi Kogyo Kabushiki Kaisha, Tokyo, Japan

[21] Appl. No.: 176,308

[22] Filed: Mar. 31, 1988

[30] Foreign Application Priority Data

Apr. 8, 1987 [JP] Japan ..... 62-86189
Dec. 10, 1987 [JP] Japan ..... 62-188039[U]

[51] Int. Cl.[4] ..... H01R 13/40

[52] U.S. Cl. ..... 439/589; 439/595; 439/598

[58] Field of Search ..... 439/595–599, 439/603, 589

[56] References Cited

U.S. PATENT DOCUMENTS 4,431,243 2/1984 Punako et al. ..... 439/603
4,583,805 4/1986 Mantlik ..... 439/595
4,721,482 1/1988 Tukuda et al. ..... 439/586
4,758,182 7/1988 Anbo et al. ..... 439/598
4,761,147 8/1988 Gauthier ..... 439/620

*Primary Examiner*—Gil Weidenfeld
*Assistant Examiner*—Paula A. Austin
*Attorney, Agent, or Firm*—Silverman, Cass, Singer & Winburn, Ltd.

[57] ABSTRACT

A drip-proof connector is used in connection between electric cables or the like and electric and electronic appliances such as cameras for televisions, servomotors for machine tools and the like. An insert of the connector is adapted to abut against an inwardly extending annular flange provided on an inside of a connector shell. With this arrangement, the drip-proof connector is simply and easily assembled or disassembled in fields without using particular tools and has a sufficient drip-proof property.

6 Claims, 3 Drawing Sheets

DRIP-PROOF CONNECTOR

BACKGROUND OF THE INVENTION

This invention relates to a drip-proof connector widely used in connection between electric cables or the like and electric and electronic appliances such as cameras for televisions, servomotors for machine tools and the like, and more particularly to an insert for a drip-proof connector.

A drip-proof connector is generally constructed by a cylindrical shell 1 made of a metal or a plastic material, an insert 2 made of an insulating elastic substance such as rubber or the like and arranged in the shell 1, and at least one contact 3 piercing through the insert 2 as shown in FIG. 1.

With the above drip-proof connector, the insert 2 is made of a material having a repulsive elasticity, for example, rubber, and an outer diameter of the insert 2 is larger than an inner diameter of the shell 1 and a diameter of a contact piercing aperture of the insert is smaller than an outer diameter of the contact so that air-tightness between the shell 1 and the insert 2 and between the contact 3 and the insert 2 is accomplished to ensure a water-proof property to a certain extent. If it is required to improve the air-tightness and water-proof property of the connector, projections 15 are provided on inside of the shell 1 or the contact 3 is provided with an enlarged portion 31 which is often coated with an adhesive. Such projections 15 and the enlarged portion 31 serve to prevent the insert 2 and the contact 3 in the shell 1 from moving relatively to the shell in its axial direction.

The drip-proof connector of the prior art above described fulfills requirements on the air-tightness and water-proof property to a certain extent. However, they are not necessarily enough and complete. Further, such a drip-proof connector of the prior art involves the following disadvantages.

(1) In most cases, contacts 3 more than five are inserted into the insert 2 of the connector. With such a plurality of contacts being inserted in the insert 2, the compressive force does not act uniforming upon surfaces of the insert 2. Such an uneven distribution of the compressive force naturally causes excess and deficiency in compressive force in places, particularly between the shell 1 and the insert 2 and between the insert 2 and the contacts 3. Therefore, water would enter through the places where the compressive force is not enough.

(2) In assembling the connector, the insert 2 is once compressed to an outer diameter smaller than an inner diameter of the shell 1 and then inserted into the shell 1. In order to remove the insert 2 from the shell 1 for some reason after assembled, therefore, a special tool is needed for the removal of the insert. Even if such a special tool is used, there is a tendency for the insert 2 to be damaged in removing it from the shell 1.

(3) The compressive force acting between the insert 2 and the shell 1 is regulated by an elasticity of the insert material. Therefore, no air-tightness (drip-proof effect) in excess of the regulation resulting from the insert material is any longer obtained.

(4) In order to obtain the air-tightness between the insert 2 and the shell 1, the pressure to be applied to the insert is fairly high. Accordingly, assembling and disassembling of the connector could not be effected in simple and easy manner. Particularly, in working sites not having sufficient tools and implements, the assembling of the connector is very difficult, if not impossible.

SUMMARY OF THE INVENTION

In view of the above circumstances, it is a primary object of the invention to provide a drip-proof connector which is able to obtain an air-tightness between an insert and a shell of the connector in a simple manner to meet the drip-proof requirement, regardless of arrangement and number of contacts to be inserted into the insert.

It is another object of the invention top provide a drip-proof connector which is able to insert into and remove an insert from a shell easily and simply without using particular tools or implements and without damaging the insert.

It is a further object of the invention to provide a drip-proof connector which is able to obtain a high air-tightness only by a small pressing force.

It is an object of the invention to provide a drip-proof connector which is easily assembled or disassembled in simple and easy manner at a site where the connector is used.

In order to accomplish the above objects, in a drip-proof connector including at least one contact, an insert having said contact inserted therein, and a shell enclosing said insert, according to the invention said insert consists of a front insert having a rubber-like elasticity and a rear insert having no rubber-like elasticity, diameters of said front and rear inserts being not more than an inner diameter of the shell, said shell being provided in its inside with an inwardly extending flange whose inner diameter is smaller than the diameter of said front insert, and a pressing cover is provided on said shell on a side of a contact tail of said contact.

In a preferred embodiment of the invention, a pressing member is interposed between the rear insert and the pressing cover.

In a further embodiment, the front insert is provided with an annular ridge on its surface abutting against the inwardly extending flange of the shell.

In order that the invention may be more clearly understood, preferred embodiments will be described, by way of example, with reference to the accompanying drawings.

DESCRIPTION OF THE PREFERRED EMBODIMENTS

Figure 1:
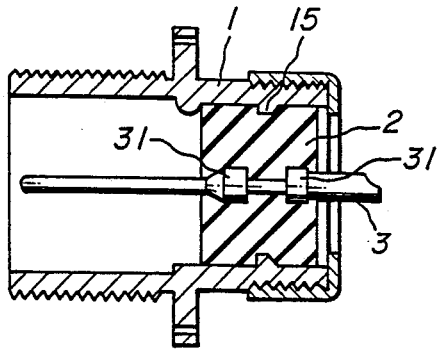
FIG 1 PRIOR ART
FIG. 1 is a sectional view of a drip-proof connector of the prior art.
Figure 2:
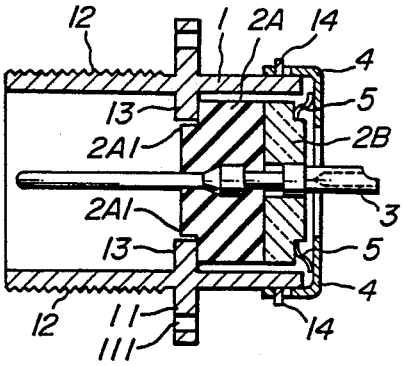
FIG. 2 is a sectional view of a drip-proof connector according to the invention.

FIG. 2 illustrates in section a typical example of the drip-proof circular connector according to the invention, which will be explained in detail. The connector shown in FIG. 2 comprises a shell 1, an insert consisting of front and rear inserts 2A and 2B, a contact 3, a pressing member 5 and a pressing cover 4. The pressing member 5 is an annular wave-like spring in this embodiment.

The shell is generally cylindrical in configuration on its outer side provided with a mounting member, for example, a flange 11 having apertures 111 through which bolts extend for mounting the connector onto an appliance. The shell is further formed on an outer surface forward of the flange 11 with fastening means, for example, threads 12 for ensuring fitting of the connector with a mating connector and preventing the connector from dislodging from the mating connector when they have been once fitted with each other. The shell is formed in its inner surface with, for example, an annular flange 13 inwardly extending to prevent the inserts 2A and 2B arranged in the shell 1 from removing therefrom in conjunction with the pressing cover 4. The pressing member 5, for example, an annular spring is interposed between the rear insert 2B and the pressing cover 4 to press the inserts 2A and 2B and to prevent them from moving in the shell 1.

According to the invention, the insert 2 has a construction divided into two parts, i.e. the front insert 2A having a rubber-like elasticity and the rear insert 2B having no rubber-like elasticity. Outer diameters of the inserts 2A and 2B are substantially equal to or smaller than an inner diameter of the shell 1. If the outer diameters of the inserts 2A and 2B were larger than the inner diameter of the shell 1, the insert 2A could not be arranged in the shell without compressing the insert 2A, and the insert 2B could not be arranged in the shell because of the hardness and rigidity of the insert 2B. On the other hand, the outer diameters of the inserts A and B considerably smaller than the inner diameter of the shell are not preferable because they tend to jump in the shell. In this case, however, such a jumping of the inserts in the shell could be prevented by providing the insert 2A with a shoulder 2A1 on its front side which is snugly fitted in the inwardly extending flange 13 formed on the inner surface of the shell 1.

Each of the inserts 2A and 2B is formed with contact piercing apertures in a predetermined positional relation, whose number corresponds to that of contacts 3. Diameters of the contact piercing apertures formed in the insert 2A are slightly smaller than outer diameters of the contacts 3 to be inserted thereinto so that the contacts 3 inserted in the insert 2A are grasped by the resilient reaction of the insert 2A and at the same time an air-tight sealing is achieved. Moreover, diameters of the contact piercing apertures formed in the insert 2B are substantially equal to or slightly larger than the outer diameters of the contacts 3 to an extent such that the contacts can be inserted into the contact piercing apertures without any trouble. Too small diameters of the contact piercing apertures would make difficult the insertion of the contacts unless additional processes are carried out. On the other hand, too large diameters of the contact piercing apertures are not preferable because they would provide plays around the contacts inserted in the insert 2B.

Figure 6:
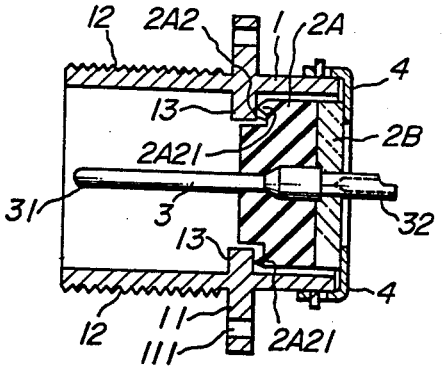
FIG. 6 is a sectional view of a connector further modified according to the invention; and FIGS. *7a–7g* are sectional views of ridges different in position and configuration provided on the insert of the connector according to the invention.
Figures 7A, 7B, 7C:
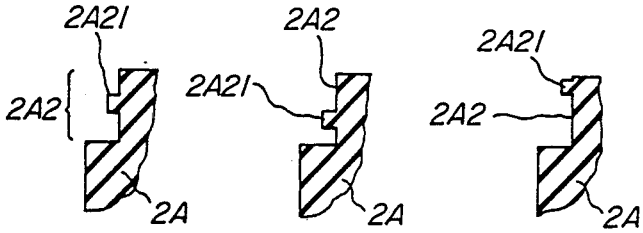
Figures 7D, 7E, 7F, 7G:
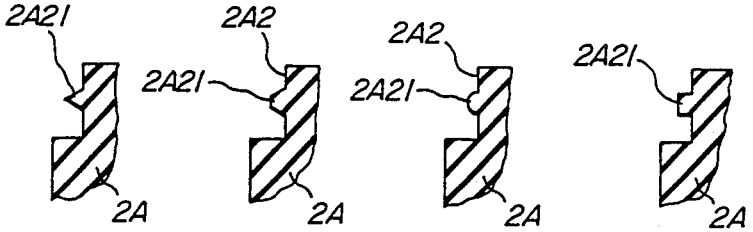

According to the invention, the insert 2A may be provided an annular ridge 2A21 on a surface 2A2 abutting against the inwardly extending flange 13 as shown in FIG. 6. In other words, the annular ridge 2A21 serves to abut against the flange 13 of the shell 1 instead of the abutment of the flat surface of the insert 2A.

Such an annular ridge 2A21 of the insert 2A can provide a connector which is superior in drip-proof without requiring a large pressing force and is easy to be assembled.

The annular ridge 2A21 may be positioned at any position, so long as it is on the abutting surface 2A2 of the insert 2A. Various positions of the ridge 2A21 are shown in FIGS. *7a*, *7b*and *7c*. The ridge 2A21 in FIG. *7a* is located substantially at a center of the abutting surface 2A2 of the insert 2A. The ridges 2A21 in FIGS. *7b* and *7c* are located inwardly and outwardly of the ridge 2A21 centrally located in FIG. *7a*.

Moreover, a sectional configuration of the ridge 2A21 may be at will without a limitation. FIGS. *7d–7g* illustrate examples of the sectional configuration of the ridge 2A21, triangular, trapezoid, semicircular and rectangular shapes.

According to the embodiment of the invention, the abutment of the front insert 2A with the inwardly extending flange 13 of the shell 1 is effected in a line contact between the flange 13 and the annular ridge-2A21 so that a sufficient air-tightness can be accomplished with a small force less than one fifth that in a surface contact.

A thickness of the front insert 2A is determined depending upon the requirement in drip-proof. The thickness of the front insert is required to provide a grasping force between the front insert 2A and the contact 3 inserted therein so as to provide an air-tightness in excess of the drip-proof requirement.

A thickness of the rear insert 2B is also determined depending upon the drip-proof requirement. In other words, the thickness of the rear insert 2B is required to have a strength sufficient to resist an urging force providing the contact between the inwardly extending flange 13 of the shell 1 and the annular ridge 2A21 of the abutting surface 2A2 of the front insert 2A so as to cause an air-tightness in excess of the drip-proof requirement.

A length of that portion of the shell 1 in which the front and rear inserts 2A and 2B are enclosed is of course shorter than the sum of the thicknesses of the front and rear inserts 2A and 2B. In other words, the length of that portion of the shell 1 is needed to be shorter than the sum of the thicknesses of the inserts by a length corresponding to a distance through which the front insert 2A is compressed to cause the urging force required between the inwardly extending flange 13 and the ridge 2A21 of the front insert 2A.

Figure 4:
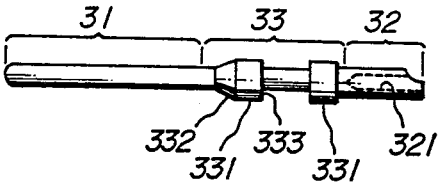
FIG. 4 illustrates a contact used in the connector according to the invention shown in FIG. 2.

Contacts for the drip-proof connector according to the invention may be any kinds of contacts used in connector of this kind. The contact 3 used in the connector shown in FIG. 2 is shown in detail in FIG. 4. The contact 3 includes a contact element 31 adapted to be fitted in a contact (not shown) of a mating connector, a tail portion 32 to be connected to a cable conductor, and a grasped portion 33 which is grasped in the inserts. The tail portion 32 is provided with a so-called "solder cup" 321 as shown in broken lines into which a cable conductor is inserted and fixed thereto by soldering or brazing. The grasped portion 33 is often provided with one or more enlarged portions 331 which serve to increase the contact grasping force of the insert 2A having the rubber-like elasticity. Moreover, one of the enlarged portion 331 is provided with a tapered portion 332 at a front end in an inserting direction, which serves to reduce the resistance occurring when the contact is inserted into the inserts. A rear end surface 333 of the enlarged portion 331 is formed at right angles to or an acute angle to a longitudinal axis so that after inserting the contact, any movement or dislodgment of the contact is prevented.

A material of the front insert 2A used in the drip-proof connector according to the invention may be any material which is an insulating material and has a repulsive elasticity. Concrete examples of the material are usual natural rubber and a synthetic rubber such as styrene-butadiene rubber, isobutylene rubber, chloroprene rubber, butyl rubber, ethylene propylene rubber, nitrile rubber, silicon rubber, fluororubber, chlorinated polyethylene, urethane rubber, acrylic rubber and the like.

A material of the rear insert 2B may be any material which is an insulating material and substantially does not have the rubber-like material. Examples of the material are ceramic materials, woods, plastic materials and the like. Plastic materials are most preferable among them. The plastic materials are hard polyvinyl chloride, polyethylene, polypropylene, polystyrene, polyester, polyamide, polycarbonate, polyacetal, polyphenylene oxide, polyvinylidene chloride and fluorine plastic and further thermoplastic resins such as various copolymers and mixed copolymers and thermosetting resins of phenol, urea and melamine types.

With the drip-proof connector according to the invention, the inserts 2A and 2B arranged in the shell 1 are pressed and held by the cover 4 provided on the shell 1 on the side of the contact tail. In this case, the cover 4 may be mounted on the shell by means of threaded engagement with threads directly formed on the shell 1 in the conventional manner. As shown in FIG. 2, however, the cover may be mounted on the shell by means of a ratchet mechanism with the aid of anchoring rods 14 provided on the shell. By using the ratchet mechanism, the portion of the shell 1 in which the inserts are enclosed can be shortened so that miniaturization of the connector and economization of materials can be accomplished.

Figure 3:
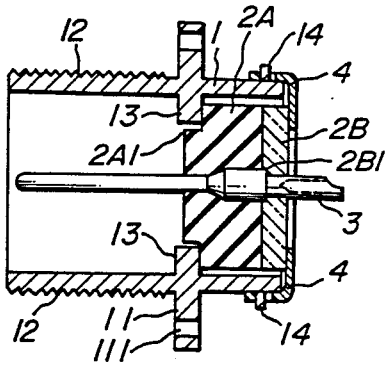
FIG. 3 is a sectional view of a drip-proof connector of another embodiment of the invention.
Figure 5:
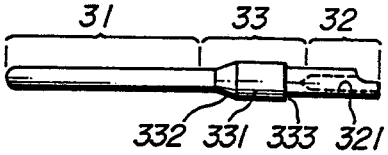
FIG. 5 illustrates another contact used in the connector according to the invention shown in FIG. 3.

FIG. 3 illustrates a contact of a further embodiment of the invention which uses a contact shown in FIG. 5. The contact shown in FIG. 5 includes only one enlarged portion 331. By providing only one enlarged portion 331, the contact 3 can be shortened. In this case, one end of the enlarged portion 331 on the side of the contact tail portion 32 preferably abuts against the hard rear insert 2B having no rubber-like elasticity so that the insert 2A(2B) can be pressed against the flange 13 of the shell 1 with the aid of the repulsive elasticity without using the pressing member 5 (FIG. 2) to provide a small-sized connector having a shorter insert receiving portion of the connector. Moreover, the rear insert may be formed with a recess 2Bl in a surface of the rear insert 2B abutting against the front insert 2A. The rear end 333 of the enlarged portion 331 of the contact is fitted in the recess 2Bl of the rear insert 2B to ensure the positioning of the contact 3 and to effectively support urging force from the cover 4.

As can be seen from the above explanation, the drip-proof connector constructed as above described according to the invention exhibits the following inherent and significant effects.

(1) As the diameters of the front and rear inserts 2A and 2B are smaller than the inner diameter of the shell 1, the front and rear inserts 2A and 2B are very easily arranged in and removed from the shell 1.

(2) As the front insert 2A having the rubber-like elasticity is urged against the flange 13 provided in the shell 1, the shell 1 and the front insert 2A are kept in an air-tight manner.

(3) As the pressing force acting upon the cover 13 is transmitted through the rear insert 2B having a rigidity, the force is uniformly transmitted onto the abutting surface or the flange 13 or the shell 1.

(4) As the rear insert 2B has the rigidity, the contact 3 is maintained in position.

(5) As the air-tightness for the drip-proof between the shell 1 and the insert 2 is accomplished by the abutment between the front insert 2A having the rubber-like elasticity and the flange 13 of the shell 1, the invention is applicable to rectangular drip-proof connectors in addition to circular connectors irrespective of numbers and arrangement of contacts provided in the insert 2.

(6) Connection of lead wires and assembling of the connector can be easily and simply carried out even on fields or working sites having no sufficient tools or implements.

What is claimed is:

1. A drip-proof connector including at least one contact, an insert having said contact inserted therein, and a shell enclosing said insert, wherein said insert consists of a front insert having a rubber-like elasticity and a rear insert having no rubber-like elasticity, diameters of said front and rear inserts being not more than an inner diameter of the shell, said shell being provided in its inside with an inwardly extending flange whose inner diameter is smaller than the diameter of said front insert, and a pressing cover is provided on said shell on a side of a contact tail of said contact.

2. A drip-proof connector as set forth in claim 1, wherein said front insert is provided with an annular shoulder arranged on a surface of the front insert abutting against said inwardly extending flange and to be fitted in said flange.

3. A drip-proof connector as set forth in claim 1, wherein said rear insert is provided with a recess in its surface abutting against the front insert, and said contact is provided with an enlarged portion which is snugly fitted in said recess of the rear insert.

4. A drip-proof connector as set forth in claim 1, wherein said front insert is provided with an annular ridge on its surface abutting against the inwardly extending flange of the shell.

5. A drip-proof connector as set forth in claim 1, wherein a pressing member is interposed between the rear insert and the pressing cover.

6. A drip-proof connector as set forth in claim 2, wherein said pressing member is an annular wave-like spring.

* * * * *